United States Patent [19]

Barnhart

[11] 4,425,600

[45] Jan. 10, 1984

[54] ELECTROLUMINESCENT WRIST LAMP FOR NIGHT VISION ENVIRONMENT

[76] Inventor: Richard L. Barnhart, 1025 Gable St., Springfield, Ohio 45505

[21] Appl. No.: 300,765

[22] Filed: Sep. 10, 1981

[51] Int. Cl.[3] ..... F21V 9/16

[52] U.S. Cl. ..... 362/84; 362/103; 362/200; 362/251; 362/295; 362/293; 362/230; 362/208

[58] Field of Search ..... 362/103, 84, 109, 111, 362/112, 119, 120, 184, 200, 295, 251, 191, 190, 108, 382, 230, 293, 208

[56] References Cited

U.S. PATENT DOCUMENTS

| | | | |
|---|---|---|---|
| 2,805,326 | 9/1957 | Schwartz . | |
| 2,953,684 | 9/1960 | MacHutchin et al. | 362/84 X |
| 3,057,992 | 10/1962 | Baker . | |
| 3,087,049 | 4/1963 | Schecter | 362/106 |
| 3,112,889 | 12/1963 | Marmo et al. . | |
| 3,308,290 | 3/1967 | Brown | 362/295 |
| 3,317,722 | 5/1967 | Whitney . | |
| 4,138,620 | 2/1979 | Dickson | 362/84 X |
| 4,144,557 | 3/1979 | Kerr et al. | 362/84 |
| 4,240,131 | 12/1980 | Albrecht | 362/267 |
| 4,319,309 | 3/1982 | Benoit | 362/186 X |

FOREIGN PATENT DOCUMENTS

| | | | |
|---|---|---|---|
| 596026 | 7/1959 | Italy | 362/103 |
| 2045914 | 11/1980 | United Kingdom | 362/108 |

OTHER PUBLICATIONS

"NVG Utility Wrist Light", Midland Ross, 6/18/83.

*Harriet Carter Distinctive Gifts,* Dept. 21, North Wales, Pa., 19454, p. 8.

*Primary Examiner*—Donald P. Walsh

*Assistant Examiner*—John S. Maples, Jr.

*Attorney, Agent, or Firm*—Donald J. Singer; Bernard E. Franz

[57] ABSTRACT

An apparatus for use in the cockpit of an aircraft which provides sufficient illumination to read the cockpit display indicators, controls and charts but does not destroy the pilot's night vision. A casing, which is normally worn on the wrist of the pilot, contains a microencapsulated electroluminescent phosphorus lamp which provides illumination that will not affect the pilot's night vision. The lamp is powered by an inverter which is connected through a switch to a power supply, all of which are also contained within the case.

3 Claims, 4 Drawing Figures

ELECTROLUMINESCENT WRIST LAMP FOR NIGHT VISION ENVIRONMENT

RIGHTS OF THE GOVERNMENT

The invention described herein may be manufactured and used by or for the Government of the United States for all governmental purposes without the payment of any royalty.

BACKGROUND OF THE INVENTION

The field of the invention is in the electroluminescent lamp art.

When piloting an aircraft at night, the retention of suitable darkness in the cockpit is important for proper night vision. Generally, the indicator lights used in the aircraft cockpit are selected to be of a wavelength which causes minimum disturbance of the pilot's night vision while still allowing him to read the various indicators and meters which he must observe. The level of background light in the cockpit, however, is not sufficient to permit ready reading of charts, etc., and heretofore it has been necessary for the pilot to use some form of extra light such as a flashlight. However, the conventional flashlight is ill adapted for cockpit use; its shape makes it unstable so that it does not remain in a set position, the light cannot be readily contained within a limited area, and the white light destroys or diminishes the pilot's adaptation to night vision, so that when he looks up from his chart reading his observation of the area surrounding the aircraft is reduced.

Night Vision Goggles, such as ITT's Modified Binocular Electronic SU-50, are sometimes used by military pilots during low level terrain-following night flights. These goggles amplify the intensity of both existing light and infrared heat which aids the pilot in his low level mission capability. However, the illumination from the incandescent lights that are used in cockpit displays is also magnified, thereby interfering with the pilot's night vision. In addition, incandescent illumination creates a flared effect when viewed through the goggles which compounds the pilot's vision problem. In an attempt at a quick-fix, some fighter pilots have placed black tape over portions of the cockpit display in an attempt to reduce the amount of emitted light. This, of course, only partially solves the night vision problem while creating the problem of operating the aircraft without being able to read all the indicators.

SUMMARY OF THE INVENTION

Fortunately, it has been discovered that the illumination from an electroluminescent phosphorus lamp is of a wavelength that neither interferes with a person's night vision, nor degrades the effectiveness of the Night Vision Goggles worn by aircraft pilots. In such a lamp, the illuminating material is electroluminescent phosphor which makes it possible for a manufacturer to fabricate the lamp as a flat surface light source. This light source is nearly indestructible, uses very little power, and can be used in areas where there is limited space to mount a light source. Because of the low power requirement, the complete device can be made very lightweight. In addition, if this light source is carefully packaged, it can be worn on a pilot's wrist. This technique leaves the pilot's hands free to operate the aircraft and yet when the pilot reaches for the controls the light source illuminates the immediate area. This device does not interfere with or hinder the pilot'normal flight duties and functions.

Also, the level of illumination is sufficient to allow the reading of charts, etc., in the cockpit without any additional light.

An object of this invention is to provide illumination in the aircraft cockpit without interfering with the pilot's night vision or his use of Night Vision Goggles.

Another object of this invention is to provide illumination in the aircraft cockpit for chart reading and still leave the pilot's hands free to operate the aircraft and perform his normal flight duties and functions.

A feature of this invention is its ability to be carried on the wrist of the user.

Another feature of this invention is its ability to operate without an external power source.

According to the invention, a novel, lightweight portable microencapsulated electroluminescent phosphorus lamp is described which is energized by a power supply coupled through an inverter which converts a DC signal from the power supply to an AC signal.

DETAILED DESCRIPTION OF THE INVENTION

Figure 1:
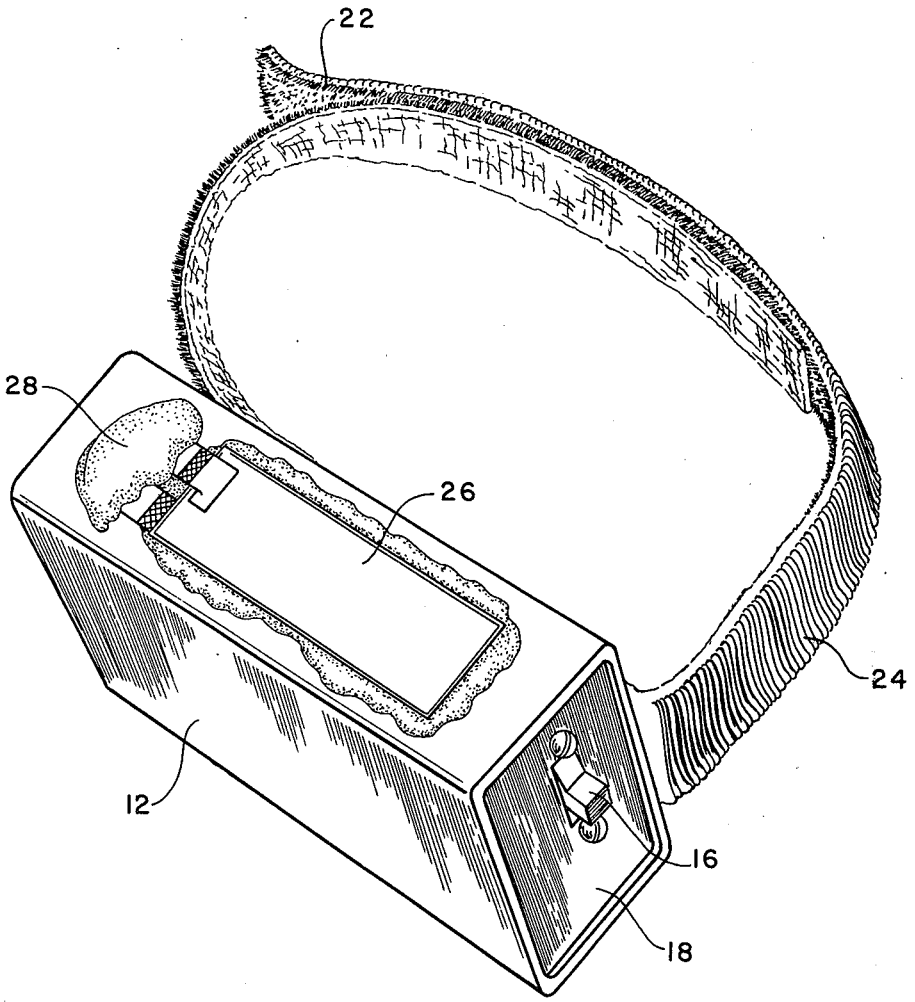
FIG. 1 is a perspective view showing one embodiment of the invention.

FIG. 1 illustrates the preferred embodiment of the invention. This embodiment includes a suitable outer casing 12, which is shown as a molded rectangular plastic box with open ends. One end of the box has a switch 16 mounted in an end panel 18. At the opposite end of the box is a second panel 20 (FIG.4) that is also mounted to the box. For operation, the panels are secured to the ends of the box by any suitable means such as, for instance, fastening screws or by indentation of the casing to fit a notch in the edge of the end panels. Both panels are shown as plastic and are removable to provide easy access to the interior of the box. These panels are interchangeable in order that the switch may be placed on the side of the wrist lamp that is most convenient to the user, which usually varies depending on whether the wrist lamp is worn on the right or left wrist.

The case is attached to a band or strap 22 which may be of any conventional form. The band shown here is made of a synthetic material which adheres when pressed together and is sold under the trademark Velcro. The backing on this material is adhesive and can be used to attach the band material to the case. Exposed adhesive that will not be affixed to the case can be covered with, for instance, a length of ribbon 24. The particular band material was chosen because it can be cut to any desired length and incorporates a hook and pile fastening system over the length of the material. This allows the band to fit both large and small wrists and even can be worn on the outside of bulky clothing covering the wrist, such as a space suit.

A microencapsulated electroluminescent phosphorus lamp 26 is mounted on the surface to the case that corresponds with the direction of desired illumination. The lamp is mounted directly to the case by means of an epoxy compound 28 which serves as an adhesive cement and as a means of covering the exposed current carrying leads of the lamp as well as protecting the edge of the lamp from moisture and humidity. Previously, moisture and humidity were the chief causes preventing widespread use of electroluminescent phosphorus lamps in such an environment. This problem has been solved with the production of microencapsulated phosphorus lamps, which is the type that has been selected for this invention. The microencapsulation process constitutes a procedure whereby a protective coating is applied to the individual elements of the electroluminescent phosphors before they are formed and fabricated into a lamp. Following fabrication, the lamp is hermetically sealed for further protection.

Figure 2:
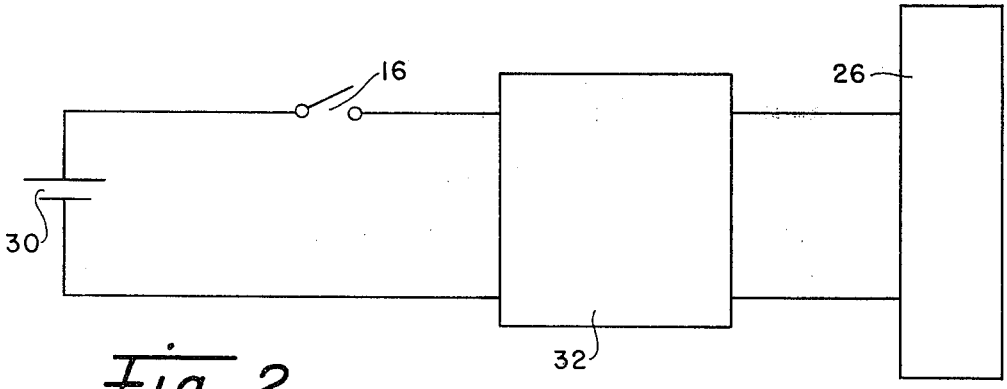
FIG. 2 is an electrical circuit block diagram of one embodiment of the invention.

Referring to the electrical block diagram in FIG. 2, a power supply 30 is connected through a switch 16 to an inverter 32. The output of the inverter is then used to drive the flat microencapsulated phosphorus lamp 26. The power supply utilized is a standard nine volt battery with snap terminals. The inverter is Grimes Manufacturing's No. 88-0015-3 which converts the nine volt DC power supply to 115 volt AC, 400 cycle power which is sufficient to drive the lamp. The lamp, typically $\frac{3}{4}'' \times 2''$ in size can be either Grimes Manufacturing's No. 94-2256-1B or Astronics Corporation's No. AES 3492. Other electroluminescent phosphorus lamps are suitable but care should be taken to select one that is fabricated using microencapsulated phosphors. The switch used is a standard SPST subminature slide switch. If desired, an attenuator could be placed in the circuit to vary the level of illumintion. An additional lamp could also be mounted on a second surface to provide illumination in a different direction.

Figure 3:
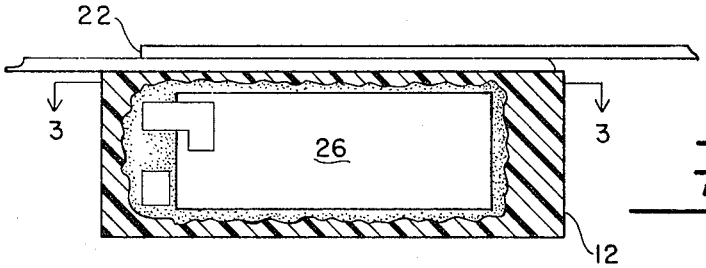
FIG. 3 is a perspective view showing the microencapsulated electroluminescent phosphorus lamp on one side of the casing.

FIG. 3 shows a side view of the casing 12 with the lamp 26 attached and the overlapping synthetic material 22 that comprises the band as it is attached to the case. As mentioned above, this material adheres to itself when pressed together. The backing of the material contains an adhesive which attaches directly to the case. The direction of overlap can be varied for the convenience of the user depending, for instance, whether the wrist lamp is worn on the right or left wrist or whether the device is worn on top of the wrist or underneath the wrist.

Figure 4:
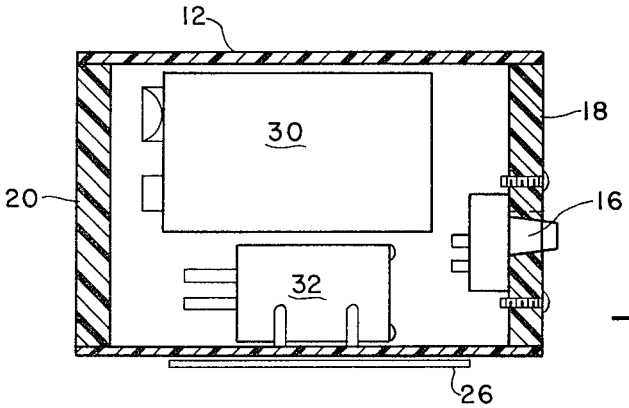
FIG. 4 is a cross-sectional view taken on line 3—3 showing details of the arrangement in the casing of the battery, inverter, switch, and lamp.

FIG. 4 shows the parts arrangement within the plastic casing 12 of the power supply 30, inverter 32, switch 16, and lamp 26. The parts layout is not critical but is presented here to show a convenient arrangement within the $3 \times 1 \times 1.875$ inch case.

Thus, while preferred constructional features of the invention are embodied in the structure illustrated herein, it is to be understood that changes and variations may be made by the skilled in the art without departing from the spirit and scope of the invention.

I claim:

1. An electroluminescent wrist flashlight comprising a housing; a strap; a battery mounted within the housing to provide a D.C. power supply; an inverter means mounted within the housing for converting power from the battery into an A.C. signal; a flat electroluminescent phosphorus lamp mounted on one surface of the housing, wherein the lamp includes phosphors which are microencapsulated and hermetically sealed, the illumination from the lamp being of a wavelength that does not interfere with a person's night vision and does not degrade the performance of night vision goggles; said housing having two end panels which are interchangable and removable to provide easy access to the interior of the housing; a switch mounted on one of the end panels, whereby the switch may be placed on either end of the housing; electrical leads interconnecting the battery, the inverter, the switch and the lamp so that when the switch is actuated there are connections from the battery to the inverter and from the inverter to the lamp to energize the lamp to provide illumination; the housing having a long dimension which is a number of times greater than its other dimensions; the long dimension being along an axis orthogonal to the end panels; the housing being attached to said strap with said axis parallel to the length of the strap, the strap being of a material which adheres when pressed together to provide a touch and close fastener which is easily closed and opened repeatedly; wherein the lamp is mounted directly to the housing by means of an epoxy compound which serves as an adhesive cement and as a means of covering the current carrying leads of the lamp as well as protecting the edge of the lamp from moisture and humidity.

2. The apparatus recited in claim 1, which further includes a second electroluminescent phosphorus lamp mounted on a different surface of said case.

3. The apparatus recited in claim 1, which further includes an attenuator means connected within said circuit for varying said electroluminescent phosphorus lamp's level of brightness.

* * * * *